United States Patent [19]

Weber

[11] Patent Number: 4,527,622

[45] Date of Patent: Jul. 9, 1985

[54] RING-SHAPED RECUPERATIVE HEAT EXCHANGER

[75] Inventor: Thomas Weber, Oberursel, Fed. Rep. of Germany

[73] Assignee: Klöckner-Humboldt-Deutz Aktiengesellschaft, Cologne, Fed. Rep. of Germany

[21] Appl. No.: 405,386

[22] Filed: Aug. 5, 1982

[30] Foreign Application Priority Data

Aug. 6, 1981 [DE] Fed. Rep. of Germany ..... 3131091

[51] Int. Cl.[3] ..... F28F 3/02

[52] U.S. Cl. ..... 165/166

[58] Field of Search ..... 165/166, 10

[56] References Cited

U.S. PATENT DOCUMENTS

| | | | |
|---|---|---|---|
| 2,428,066 | 9/1947 | Ellis | 165/166 |
| 2,429,508 | 10/1947 | Belaieff | 165/166 |
| 2,792,200 | 5/1957 | Huggins et al. | 165/154 |
| 3,015,475 | 1/1962 | Meijer et al. | 165/166 |
| 3,289,757 | 12/1966 | Rutledge | 165/166 |
| 3,430,694 | 3/1969 | Cardell | 165/166 |
| 3,818,984 | 6/1974 | Nakamura et al. | 165/166 |
| 3,831,374 | 8/1974 | Nicita | 165/166 X |
| 4,098,330 | 7/1978 | Flower et al. | 165/166 |
| 4,178,991 | 12/1979 | Bieri | 165/166 |

FOREIGN PATENT DOCUMENTS

| | | | |
|---|---|---|---|
| 71781 | 2/1983 | European Pat. Off. | 165/166 |
| 2162888 | 7/1972 | Fed. Rep. of Germany . | |
| 3001568 | 7/1981 | Fed. Rep. of Germany | 165/166 |

*Primary Examiner*—Sheldon J. Richter

*Attorney, Agent, or Firm*—Becker & Becker, Inc.

[57] ABSTRACT

A ring-shaped recuperative heat exchanger, for instance for small gas turbines, having axial channels for the exhaust gas system with increasing channel width over the diameter thereof, and having guide plates in a wavy shape for increasing the surface thereof. In an embodiment as a parallel flow or counterflow heat exchanger, the air supply channels are constructed in an identical or similar manner, with a separation of the channels from each other being effected by radially disposed intermediate plates. In a construction as a crossflow heat exchanger, the air conveying channels are formed by wavy shaped guide plates having constant wave height and wave width in a radial alignment. The separation between hot gas and air conveying channels is again effected by additional approximately radially disposed intermediate plates.

3 Claims, 8 Drawing Figures

RING-SHAPED RECUPERATIVE HEAT EXCHANGER

BACKGROUND OF THE INVENTION

1. Field of the Invention

The present invention relates to a ring-shaped or annular recuperative heat exchanger having wavy or meander-shaped guide plates for increasing the heat exchanger surface. This heat exchanger is preferably provided for coaxial arrangement on gas turbine units.

2. Description of the Prior Art

A ring-shaped heat exchanger of this type is disclosed in German Offenlegungsschrift 21 62 888; this heat exchanger has radial flow therethrough in counter flow. The essential disadvantages of the arrangement described in German Offenlegungsschrift 21 62 888 are in the respectively double directional reversal of the respectively axially in-flowing gas flows, and in the cross sectional widening or narrowing of the gas passages caused by the strictly radial arrangement of the selected plates.

SUMMARY OF THE INVENTION

It is an object of the present invention to provide a ring-shaped or annular heat exchanger which can be organically installed in a flow dynamic manner in an overall system, especially in a gas turbine unit, and which approaches an optimum design aerodynamically and thermodynamically, with an uncomplicated manufacture of the guide plates which form the heat exchanger surface being possible.

This object, and other objects and advantages of the present invention, will appear more clearly from the following specification in connection with the accompanying drawings.

Figure 3:
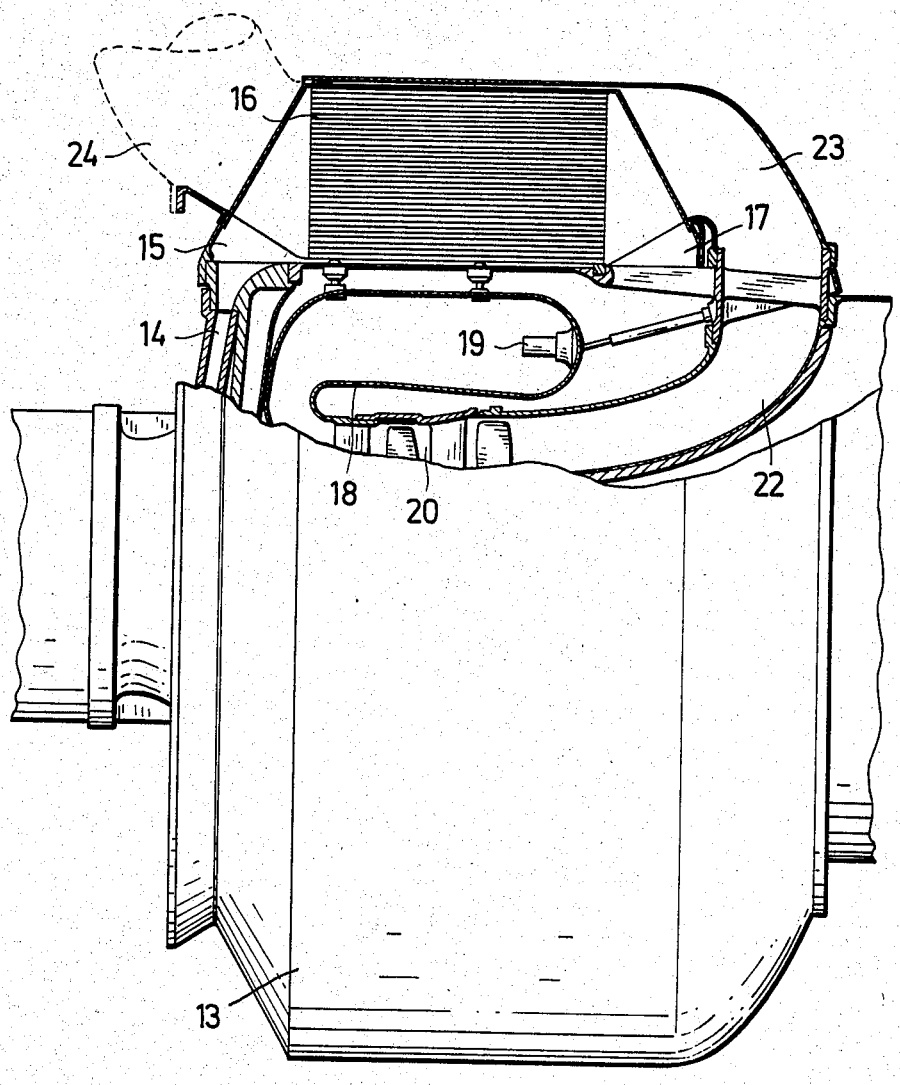
Figure 4:
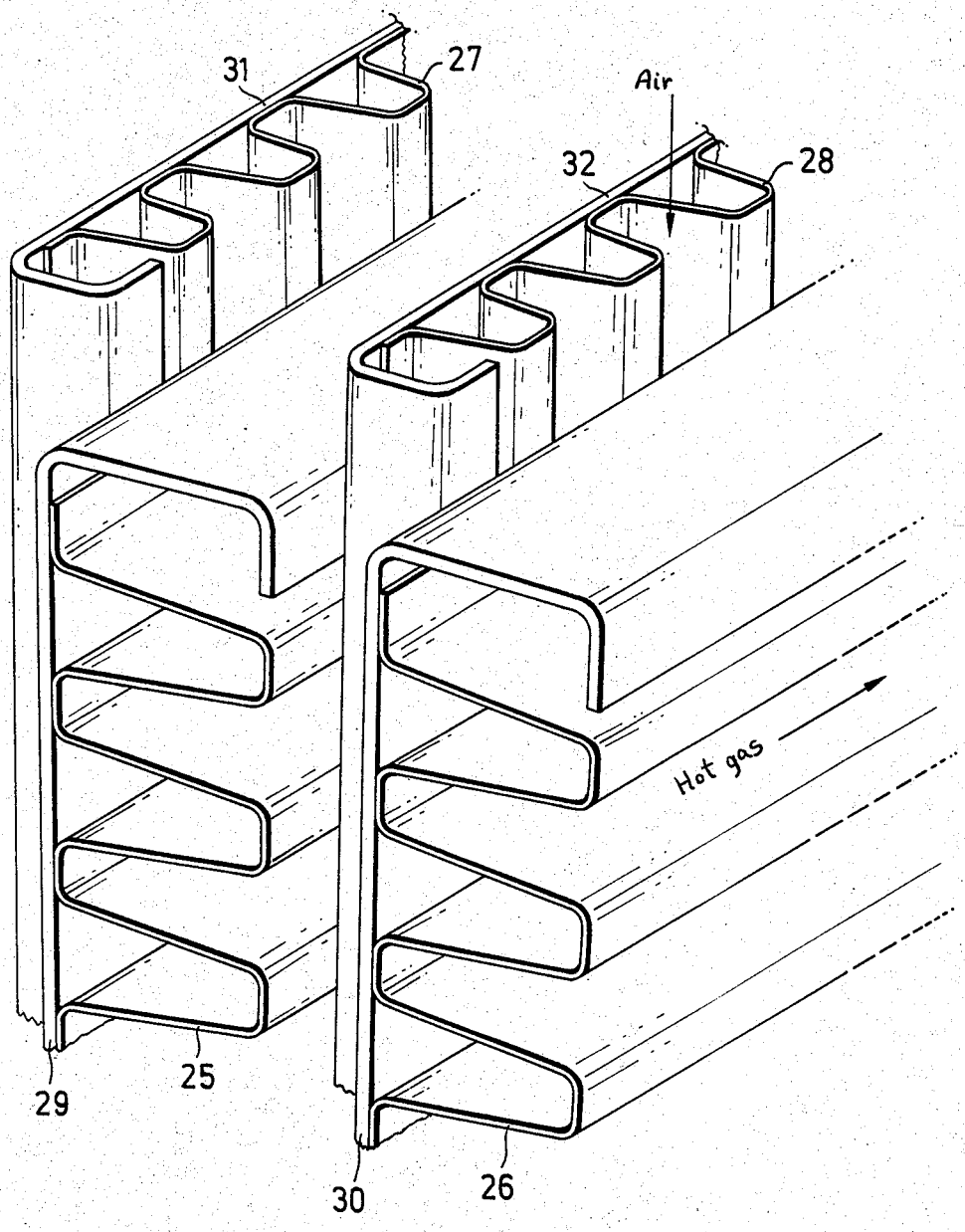
Figure 6:
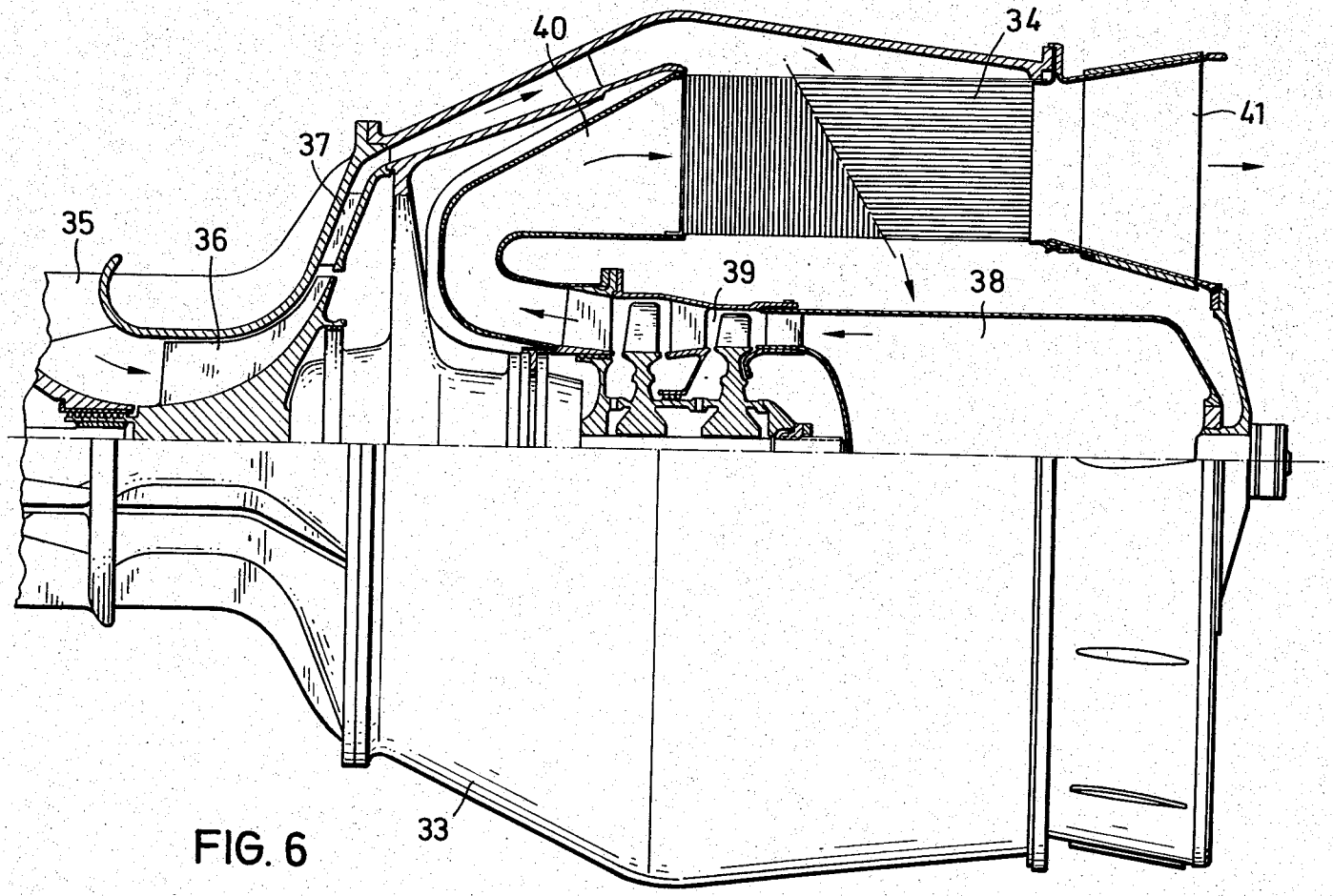

FIGS. *2a* and *2b* show in cross section the inside and outside respectively of the heat exchanger matrix for an inventive counterflow annular heat exchanger;

FIG. 3 shows the arrangement of an inventive counterflow annular heat exchanger on a small gas turbine;

FIG. 4 shows two axial and two radial guide plates as well as intermediate plates of an inventive crossflow annular heat exchanger;

FIGS. *5a* and *5b* show the heat exchanger matrix of an inventive crossflow annular heat exchanger in cross section and in a cylindrical section; and FIG. 6 shows the arrangement of an inventive crossflow annular heat exchanger on a gas turbine.

DETAILED DESCRIPTION

The heat exchanger of the present invention is characterized primarily in that in the circumferential direction, at least every other guide plate is provided with axially parallel surface lines, has a wave height which increases as the distance from the central axis increases and in a wedge-shaped heat exchanger element, forms walls for channels having axial flow therethrough.

Axial flow through at least one of the systems permits simplification of the inlet and outlet passages, as a result of which considerable gain is attained with respect to the flow losses and heat losses. This outweighs by far the slight disadvantage that due to an outwardly increasing channel width, an optimization can only be sought in the middle range. Such a mathematical optimization of the channel cross sections is valid in any case only for particular temperature and flow conditions. The design with axially parallel surfaces permits a simple folding of the guide plates in respectively parallel lines.

An especially compact construction is possible with purely axial throughflow in counterflow or parallel flow, with the outer cover or mantle of the heat exchanger already representing the contour or shape for the overall apparatus. In a particular embodiment, the guide plates are identical except for their cross sections. An advantageous guidance of the gas flows can be achieved in a simple manner by constructing intermediate plates with triangular end regions.

An improved embodiment of a ring-shaped heat exchanger for the crossflow principle is attained, along with the inventive construction of the guide plates in axial channels, by likewise folding the guide plates along parallel lines for the radial channels with constant cross section. Possibly provided intermediate plates for the axial channels are hereby respectively offset slightly from the radial arrangement.

According to specific embodiments of the present invention, only guide plates need be provided which have axially parallel surface lines and which form channels having axial flow therethrough with each other or with essentially radially disposed planar intermediate plates.

Every other guide plate may have a wave height which remains constant as the distance from the central axis increases, and, may form walls of channels having axial flow therethrough in a parallel-walled heat exchanger element.

The intermediate plates, at the two straight edges (i.e. the radially inner and outer edges) of adjacent guide plates, may be bent or folded at nearly right angles and always in the same circumferential direction over and beyond the height of the channels, so that the legs of the U-shaped cross section thereof rest against the next intermediate plate in a stacked-like manner, thus closing off the outer most and innermost channels. The intermediate plates may end in triangular pieces which project beyond the end face (i.e. axial) edges of the guide plates; the two free sides of each triangular end piece respectively may be bent at right angles in opposide directions and may cooperate with the triangular pieces of the immediately adjacent intermediate plates, the corresponding free sides of which are bent in mirror symmetry, to form gas conveying channels which alternately open radially inwardly and outwardly.

In the circumferential direction, every other guide plate may form channels having radial flow therethrough with adjoining guide plates or with essentially radially disposed planar intermediate plates. In the circumferential direction, each guide plate which forms channels having radial flow therethrough may be provided with surface lines which are parallel to each other and at right angles to the axis; furthermore, the channels of these guide plates have a constant wave height and wave width as the distance from the central axis increases and parallel to the central axis; these guide plates form walls of the channels having radial flow therethrough in a parallel-walled heat exchanger element.

Those channels intended for air may have a smaller cross section than those intended for hot gas.

The intermediate plates, at the two straight edges (i.e. the radially and axially outer and inner edges) of adjacent guide plates, may be bent twice in the same direction at right angles in conformity with the spacing of the respective channel width to thus close off the outer channels and form an abutment for the adjoining intermediate plates.

The present invention also provides a method of producing such ring-shaped recuperative heat exchangers; this method is characterized primarily by the step of soldering complete, in a single setting or clamping, a heat exchanger ring comprising guide plates and possibly intermediate plates.

Figure 1:
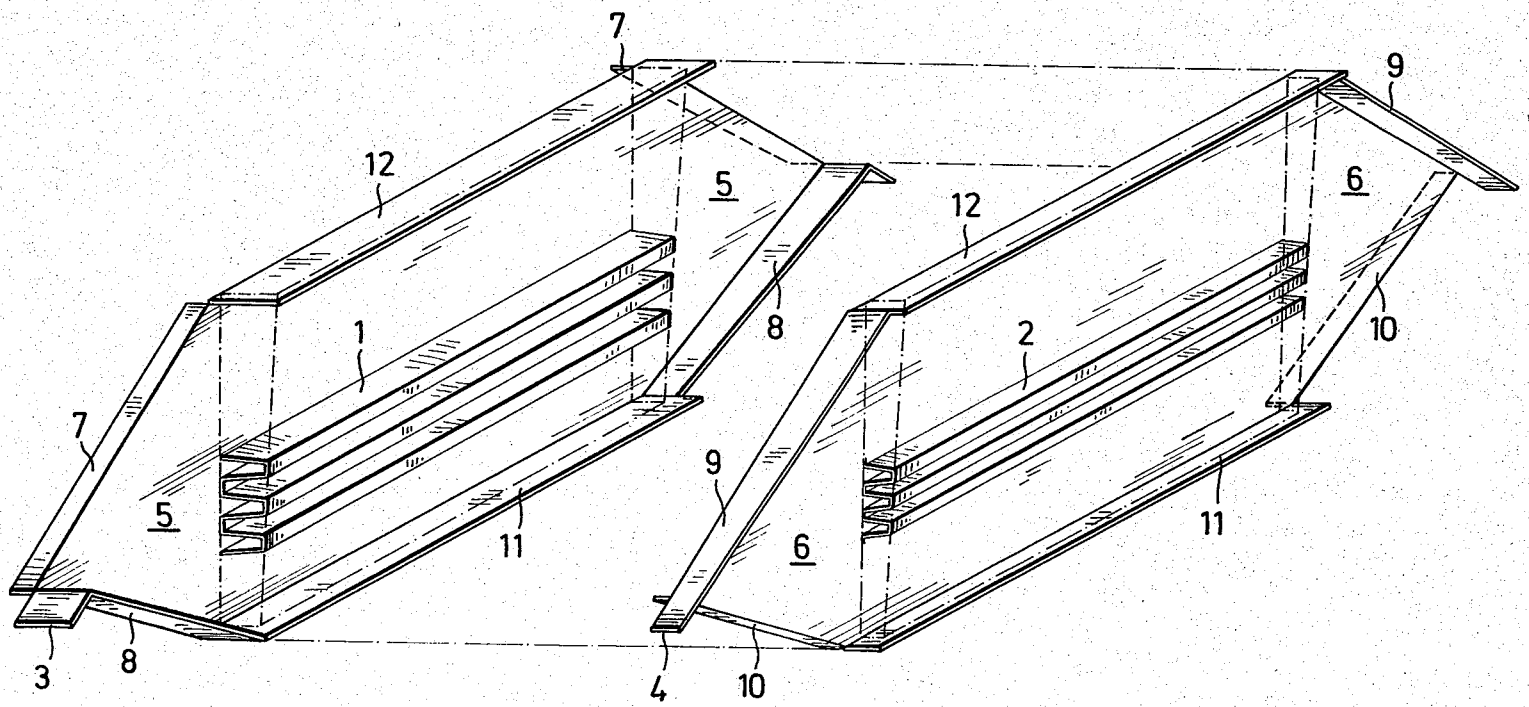
FIG. 1 shows two guide plates and two intermediate plates of an inventive counterflow annular heat exchanger.

Referring now to the drawings in detail, FIG. 1 shows two adjacent wavy or corrugated guide plates 1, 2, one of which is located in a hot gas flow, and the other of which is located in a cold air flow. The guide plates 1, 2 respectively form a wedge-shaped heat exchanger element with an intermediate plate 3, 4 associated therewith. The intermediate plates 3, 4 have triangular end pieces 5, 6, adjacent ones of which respectively have pairs of the same free sides 7, 8 and 9, 10 bent out at right angles to the end pieces and in opposite directions to each other, with corresponding sides 7, 9, and 8, 10 being bent out in opposite directions from their associated end pieces 5, 6, so that when joining together the two illustrated wedge elements, which respectively comprise the guide plate 1 or 2 and the intermediate plate 3, or 4, a partial covering of adjoining folded or bent strips 8 and 10 occurs. Inlet and outlet openings which remain free are thus formed and are respectively alternately inclined inwardly and outwardly. In FIG. 1, the longitudinal edges of the intermediate plates 3, 4 are also bent or folded over at right angles in the same manner so as to project over the guide plates 1, 2, so that inner and outer cylindrical strips 11, 12 form which will respectively partially cover one another.

Figure 2B:
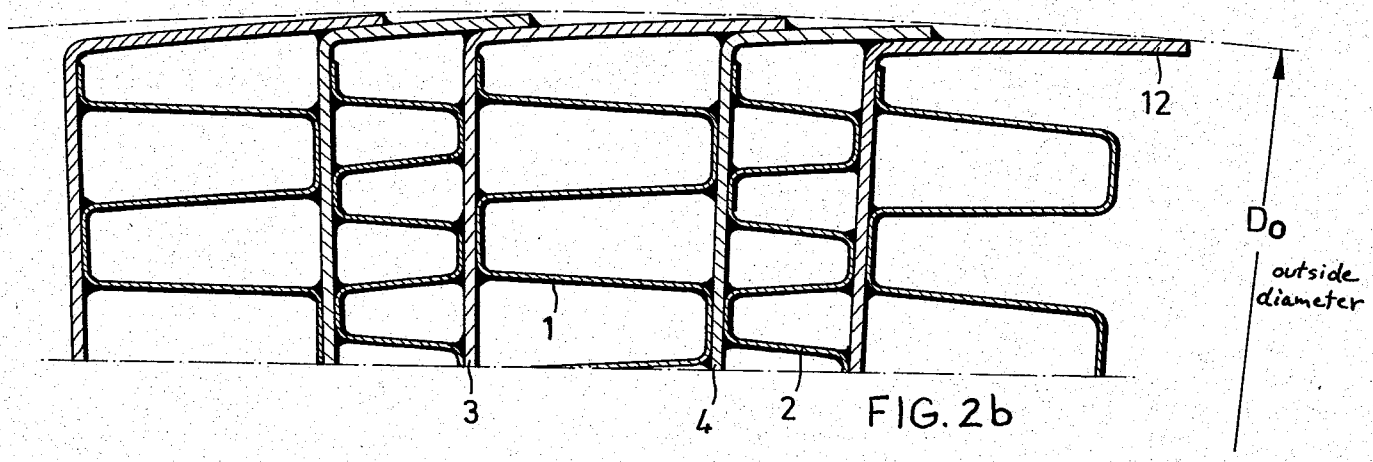
Figure 2A:
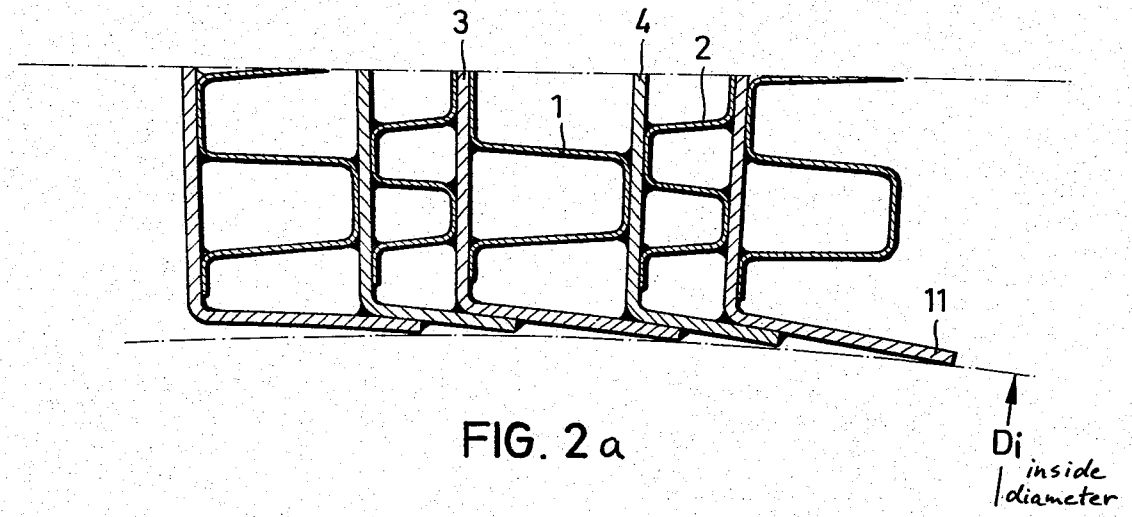

FIGS. 2*a* and 2*b* show a portion of a counterflow heat exchanger matrix using the elements of FIG. 1, with channel widths increasing from the inside to the outside. The wavy or corrugated guide plates 1, 2 for hot gas and for cold air respectively have clearly different wave heights. The intermediate plates 3 and 4 respectively have inner and outer cylinder strips 11, 12 which cover one another. The guide plates 1, 2 are in a trapezoidal shape.

FIG. 3 shows in a partial section a small gas turbine 13 with an inventive counterflow annular heat exchanger. The air for combustion discharges from a compressor, not shown in the section, via a diffuser 14 in the air inlet region 15 at the annular heat exchanger. From here the air for combustion passes via the appropriate axial cold air channels in the heat exchanger matrix 16 into the air discharge region 17, and from there into the combustion chamber 18 with the burner 19. The combustion gases drive the partially sectioned axial turbine 20, and flow via the exhaust gas passage 22 and the hot gas inlet 23 to the heat exchanger matrix 16, the hot gas channels of which lead to the exhaust gas outlet 24.

FIG. 4 shows two wavy or corrugated guide plates 25, 26 for axial flow therethrough, and two wavy or corrugated guide plates 27, 28 for radial flow therethrough. The first mentioned guide plates 25, 26 respectively form wedge-shaped heat exchanger elements with the intermediate plates 29, 30. Therebetween the guide plates 27, 28 form plate-like heat exchanger elements of constant thickness with further intermediate plates 31, 32 arranged in the manner in the circumferential direction. The intermediate plates 29, 30, 31, 32 are respectively bent or angled twice at right angles at the end of the wave train associated therewith and thus form a reinforcement and a termination of the corresponding heat exchanger elements.

Figure 5B:
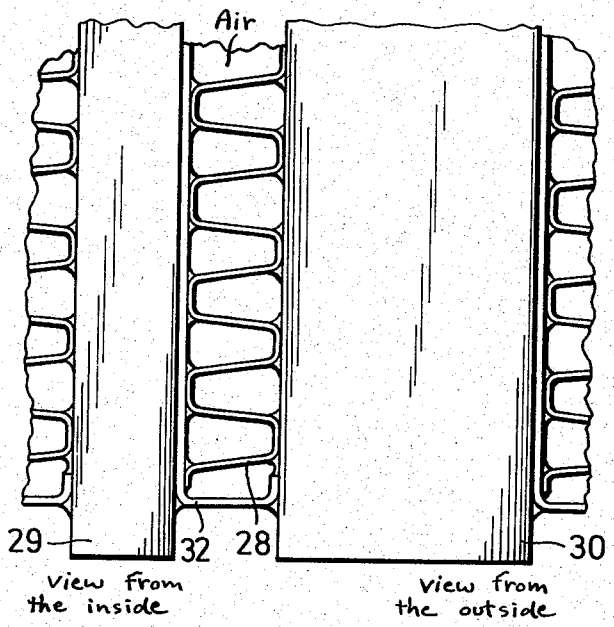
Figure 5A:
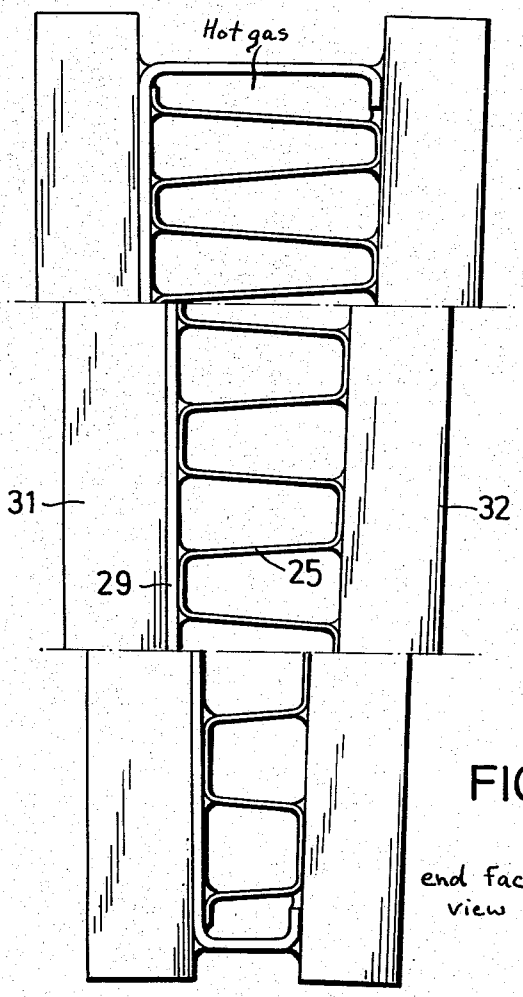

FIG. 5*a* shows three views of different diameter regions of an inventive crossflow annular heat exchanger from the end face, and shows one wedge-shaped element for axial throughflow, and two adjoining parallel-walled plate elements for radial throughflow. In FIG. 5*b*, the plan view of a circumferential portion of the crossflow annular heat exchanger, in half illustrations from the inside and from the outside, shows three elements for radial throughflow, and two elements for axial throughflow. The base of the wedge-shaped element is narrower than the head thereof. The individual reference numerals designate the same elements as in FIG. 4.

FIG. 6 shows, in the half section, a gas turbine drive unit 33 with an inventive crossflow annular heat exchanger 34. The compressor air enters at the air inlet 35, passes via the radial compressor 36 into the diffuser 37, and flows through the matrix of the heat exchanger 34 radially from the outside to the inside. The combustion gases pass via the combustion chamber 38 and the axial turbine 39 into the exhaust gas passage 40, flow axially through the heat exchanger matrix, and leave the heat exchanger 34 at the exhaust gas outlet 41.

The present invention is, of course, in no way restricted to the specific disclosure of the specification and drawings, but also encompasses any modifications within the scope of the appended claims.

What is claimed is:

1. A ring-shaped recuperative heat exchanger having an inner ring diameter and an outer ring diameter therewith for two gaseous heat exchanging media in a gas turbine system and having a central axis according to direct-/counter-flow principle, said heat exchanger in combination comprising: intermediate plates extending in approximately radial direction from the inner ring diameter to the outer ring diameter of the heat exchanger, wavy guide plates for increasing the heat exchanger surface and arranged between said intermediate plates which are essentially even and extend parallel to the axis of the heat exchanger; when viewed in the circumferential direction, at least every other guide plate being provided with axially parallel surface lines and extending from approximately the inner ring diameter as far as approximately to the outer ring diameter of the heat exchanger, having a wave height which increases as the distance from said central axis increases to form a wedge-shaped heat exchanger element, and forming walls for channels having axial flow therethrough, said guide plates extending parallel to the axis of the heat exchanger and forming the channels located serially in radial direction of the heat exchanger respectively between two said intermediate plates, which channels have the same medium flowing therethrough in axial direction of the heat exchanger, all of said guide plates having axially parallel surface lines, said guide plates respectively cooperating with essentially radially disposed planar intermediate plates to form said channels having axial flow therethrough, the radially inner and outer ends of said intermediate plates being respectively bent at nearly right angles and all extending in the same circumferential direction over and beyond the height of said channels to form U-shaped intermediate plates having legs which rest against the next intermediate plate in a stacked-like manner to close off the radially innermost and outermost channels, the ends of said intermediate plates, when viewed in the axial direction, respectively being provided with triangular end pieces which project axially beyond the axial end faces of said guide plates, with the two free sides of each triangular end piece being respectively bent at right angles in opposite directions, with the corresponding free sides of adjacent intermediate plates being bent in mirror symmetry, with the corresponding free sides of triangular end pieces of adjacent intermediate plates cooperating to form channels which alternately open essentially radially inwardly and outwardly.

2. A heat exchanger in combination according to claim 1, in which every other second guide plate has a wave height which remains constant as the distance from said central axis increases, to form parallel-walled heat exchanger elements, and formed therewith walls for channels having axial flow therethrough.

3. A heat exchanger in combination according to claim 1, which includes channels of a first cross section for air, and channels of a second greater cross section for hot gas.

* * * * *